US009370700B2

(12) United States Patent
Regan

(10) Patent No.: US 9,370,700 B2
(45) Date of Patent: Jun. 21, 2016

(54) LACROSSE STICK WITH QUICKLY ADJUSTABLE POCKET

(71) Applicant: Robert K Regan, Wheaton, IL (US)

(72) Inventor: Robert K Regan, Wheaton, IL (US)

(73) Assignee: Cool Stick, LLC, Wheaton, IL (US)

( * ) Notice: Subject to any disclaimer, the term of this patent is extended or adjusted under 35 U.S.C. 154(b) by 85 days.

(21) Appl. No.: 14/489,826

(22) Filed: Sep. 18, 2014

(65) Prior Publication Data

US 2016/0082328 A1 Mar. 24, 2016

(51) Int. Cl.
*A63B 59/12* (2006.01)
*A63B 65/12* (2006.01)
*A63B 59/02* (2006.01)

(52) U.S. Cl.
CPC ..... *A63B 59/02* (2013.01); *A63B 2243/005* (2013.01)

(58) Field of Classification Search
CPC ..... A63B 59/02
USPC ..... 473/513, 505, 510; D21/724
See application file for complete search history.

(56) References Cited

U.S. PATENT DOCUMENTS

| | | | | | |
|---|---|---|---|---|---|
| 2,039,138 | A * | 4/1936 | Auer | A63B 59/20 | 473/513 |
| 2,142,527 | A * | 1/1939 | Pool | A63B 59/20 | 473/513 |
| 3,473,806 | A * | 10/1969 | Patterson | A63B 59/20 | 473/513 |
| 3,507,495 | A * | 4/1970 | Fracalossi | A63B 59/20 | 264/331.19 |
| 3,822,062 | A * | 7/1974 | Tucker | A63B 59/20 | 473/513 |
| 4,049,273 | A * | 9/1977 | Pool | A63B 59/20 | 473/513 |
| 4,097,046 | A * | 6/1978 | Friant | A63B 59/20 | 473/513 |
| 4,861,042 | A * | 8/1989 | Trettin | A63B 59/20 | 473/513 |
| 4,938,480 | A * | 7/1990 | Lods | A63B 59/20 | 473/513 |
| 5,037,112 | A * | 8/1991 | Brine, III | A63B 59/20 | 473/513 |
| 5,494,297 | A | 2/1996 | MacNeil | | |
| RE37,894 | E | 10/2002 | MacNeil | | |
| 6,962,541 | B2 | 11/2005 | Mitzak | | |
| 8,075,428 | B2 | 12/2011 | Gait | | |
| 2002/0107094 | A1* | 8/2002 | LeMire | A63B 59/20 | 473/413 |
| 2004/0229718 | A1* | 11/2004 | Samaras | A63B 59/20 | 473/513 |
| 2010/0190590 | A1* | 7/2010 | Sobel | A63B 59/20 | 473/513 |

OTHER PUBLICATIONS

Webpage download, Laxallstars2013, 2013, web.archive.org/web/20130806194814/http:/laxallstars.com/traditional-thursday-goalie-pita-style/, 2 pages.*
Webpage download, Ecocrafta2013, 2013, web.archive.org/web/20130629071914/http://www.ecocrafta.com/2013/02/basic-macrame-knots.html, 6 pages.*
Webpage download, xxxxx, 2013, xxxx, 3 pages.*
Webpage download, Elacrosse 2003, 2003, www.e-lacrosse.com/stech72.htm, 5 pages.*
Webpage download, Insidelacrosse2005, 2005, forums.insidelacrosse.com/showthread.php?22085-Tutorial-Snatch-N-Grab-Pocket, 16 pages.*
Webpage download, Swiftwaterrescue2012, 2012, swiftwaterrescue.com/swiftwater-rescue/twelve-knots-to-know-in-2012/, 1 page.*

* cited by examiner

*Primary Examiner* — Gene Kim
*Assistant Examiner* — M Chambers
(74) *Attorney, Agent, or Firm* — Michael P. Mazzo, LLC

(57) ABSTRACT

A lacrosse stick head with a quickly adjustable pocket.

5 Claims, 4 Drawing Sheets

Fig. 1
PRIOR ART
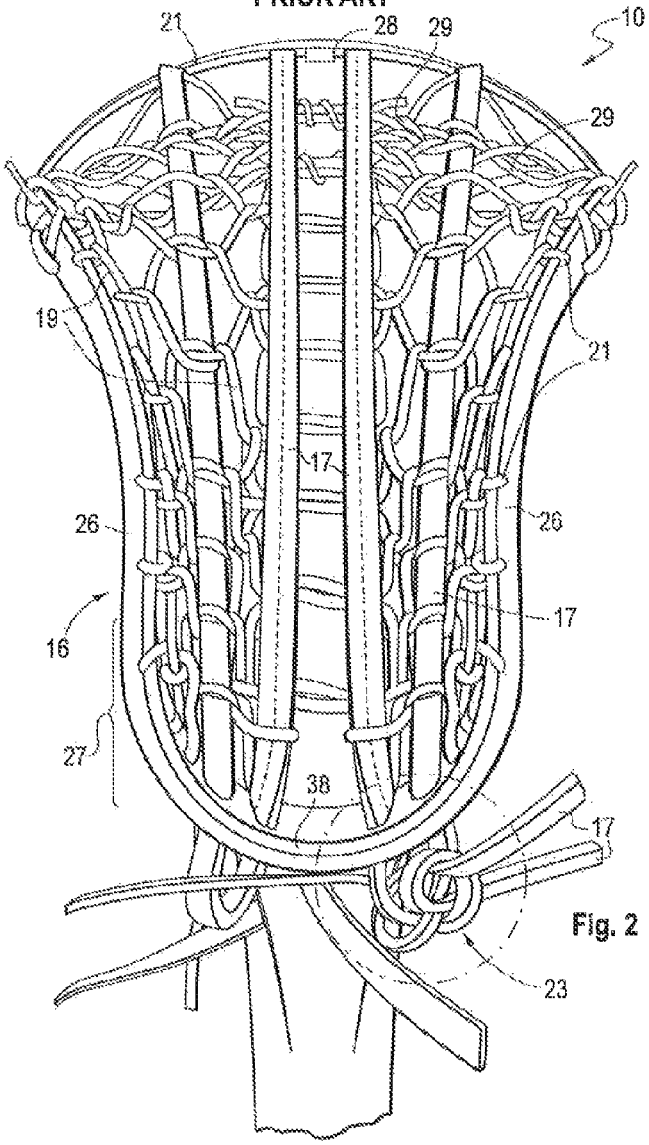
Fig. 2
Fig. 2
PRIOR ART
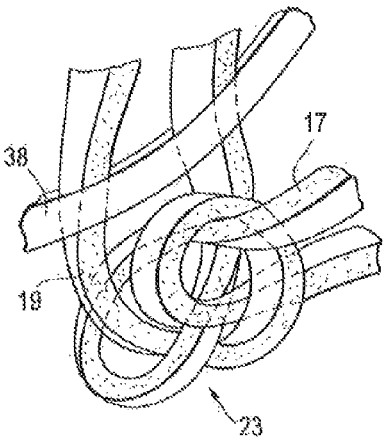

LACROSSE STICK WITH QUICKLY ADJUSTABLE POCKET

BACKGROUND OF THE INVENTION

The present invention generally relates to lacrosse sticks, and more specifically to an adjustable pocket in the head of a lacrosse stick.

This invention is used in the sport of lacrosse, which is considered the oldest team contact sport in North America, and one of its fastest-growing sports. Lacrosse is played with sticks called A crosse used for catching, carrying and throwing a ball into the opposing team's goal.

Referring to FIGS. 1-2, a conventional lacrosse stick 10 is shown. Lacrosse stick 10 generally includes a stick portion (not shown) and a head portion 16. One end of the stick can be affixed to throat 15 which may be part of head 16. The head of the lacrosse stick includes a frame. Strung across the frame, with varying degrees of looseness or tension, are flexible elements such as strings, thongs and/or netting material. Throat section 15 includes a ball stop area 27 for impacting a ball and a socket (not shown) for receiving the handle. A pair of sidewalls 26 meet in a bottom wall section 38 of the head, adjacent throat section 15 and proximate the ball stop area 27. Sidewalls 26 are joined at the top forming a lip or scoop 28.

Within the head frame, the thong and/or netting material are typically strung either traditionally (a complex pattern of leather and nylon strings woven together) or in mesh (a piece of mesh material attached to the head by nylon strings) to create what is known as a pocket. The had frame supports the flexible netting which creates a ball pocket, traditionally located in the midsection of the head. According to the jargon of the sport, a hall in play will be held in the pocket. The pocket is an area of slack in the flexible elements, creating a cup-shaped or generally V-shaped depression. An important factor in how each individual pocket throws (the degree up or down out of the pocket when the ball is released) is the tension, controlled in smaller part by the shooting strings and in larger part by longitudinal thongs. (Here, "tension" refers to the amount of slack or excess length in the flexible elements of the head.)

In a popular lacrosse stick type, head 16 may include 4-5 longitudinally extending thongs 17, two (for women) or three (for men) shooting strings 29, and a plurality of cross-laces 19. Thongs 17 may be made of rawhide, leather, nylon or other materials. Thongs 17 extend longitudinally along the head, and are connected to opposing walls of the head by apertures formed in the top or lip portion and apertures in the region of the throat. Cross-laces 19 form a transverse bracing for the pocket, intertwining between the thongs and connect to opposing sidewalls of the head using sidewall apertures. (U.S. Lacrosse Rule No. 9, §20 currently provides that 4-5 longitudinal leather and/or synthetic thongs shall be used, and that 8-12 knots/stitches of cross-lacing shall be used, with the 8-12 knots/stitches intertwining nylon cross-laces at a common place on a thong.

Thus, thongs 17 are conventionally strung through head apertures 21 and pulled to a desirable tension, forming with cross-laces 19 a generally cup-shaped trough for receiving a lacrosse ball, and secured to apertures 21 by a plurality of knots 23. To change the tension of thongs 17, knots 23 must first be un-done, which can be a cumbersome and time-consuming process, particularly in cold and/or rainy conditions when fingers are not limber and the knots may be damp.

The head may be made of a substantially rigid, light-weight material such as nylon or wood. Nylon 66 or wood are currently preferred materials. Reinforcing brackets (not shown) may be molded integrally with the sidewalls 30 and extend substantially normal to the interior surfaces of the sidewalls, adding rigidity to the sidewalls, and also serving as a ball retention aid because they overlay the netting in the vicinity of the ball pocket.

In the game of lacrosse, the head is used to catch the ball, hold and carry the ball, and pass or shoot the ball. To this end, there have been several attempts to improve the lacrosse head to enhance the playing of lacrosse. However, there has been no satisfactory means of providing a lacrosse stick head which enables on-the-fly adjustment of the pocket. This would be very useful, as referees typically check pocket depth for legality minutes before each game, and if the stick is found illegal, the pocket must be adjusted and re-checked immediately, or the stick must be removed from play. Currently, there is insufficient time to adjust pocket depth before a game if a stick is found to be illegal for this reason. The present invention allows on-the-fly adjustments to be made to the pocket depth in seconds, allowing a stick deemed illegal before a game to be adjusted and used in that same game.

DEFINITION OF CLAIM TERMS

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

"Pinch point" means an area of substantial frictional engagement with the thong, which may involve the thong contacting an aperture surface, a head sidewall and/or string, nylon or other materials.

SUMMARY OF THE INVENTION

The objects mentioned above, as well as other objects, are solved by the present invention, which overcomes disadvantages of prior lacrosse sticks, while providing new advantages not previously obtainable.

As explained below, by simply tensioning a thong and a corresponding adjustment mechanism such as a string, a player or coach can adjust and cinch the thong, and thereby adjust the pocket depth of a lacrosse stick in a matter of seconds.

In one preferred embodiment of the present invention, a lacrosse stick head with a quickly adjustable pocket is provided, and includes a frame extending in a longitudinal direction and having four frame sections, including opposing side wall sections, and opposing lip and throat frame sections. Each of the four frame sections includes a plurality of apertures. A pocket is formed within the four frame sections, which includes latitudinally-extending cross-stitching attached to the sidewall apertures, and longitudinally-extending thongs whose opposing ends are attached to apertures on the lip and throat sections. The ends of two or more thongs are adjustably connected to corresponding throat frame section apertures. An end of each of the two or more thongs is secured by at least two pinch points, including a portion of the throat frame section and a throat frame section aperture. The pinch points for each of the two or more thongs form a thong loop which is connected to an adjustment mechanism. Tensioning the adjustment mechanism enlarges the thong loop, allowing the corresponding thong to be tightened or loosened. The thongs may be made of rawhide, leather, string, nylon or other materials.

A method for providing a lacrosse stick head with a quickly adjustable pocket also forms a part of the present invention. The head includes a frame extending in a longitudinal direction and having four frame sections, including opposing sidewall sections, and lip and throat sections. Each of the four frame sections includes a plurality of apertures. A pocket in the head is formed using the four frame sections, by attaching latitidunally-extending cross-stitching to opposing apertures on the sidewalls, and by attaching longitudinally-extending thongs to apertures on the lip and throat sections. The ends of two or more thongs are adjustably connected to corresponding throat section apertures, such that an end of each of the two or more thongs is secured by at least two pinch points. The pinch points for each of the two or more thongs form a thong loop which is attached to an adjustment mechanism. Tensioning the adjustment mechanism enlarges the thong loop, allowing the corresponding thong to be tightened or loosened.

When increasing tension in a thong of the pocket, pulling on the corresponding adjustment mechanism in a longitudinal direction opposite to that of the lip section enlarges a portion of the corresponding thong loop located on a side of the throat frame section outside of the pocket. The thong may now be cinched in its new, tightened position by pulling on a free end of the thong.

When decreasing tension in a thong of the pocket, pulling on the corresponding adjustment mechanism in a longitudinal direction toward the lip section enlarges a portion of the corresponding loop located on a side of the throat frame section within the pocket. The thong may now be cinched in its new, slackened position by pulling on a portion of the thong located inside the head.

Other embodiments in keeping with the principles of the invention will be apparent to those of ordinary skill in the art, particularly after review of the following detailed description of the preferred embodiments and accompanying drawings.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

FIG. 1 is a front view of a conventional lacrosse stick head;

FIG. 2 is an enlarged perspective view of the circled portion of FIG. 1;

Figure 3:
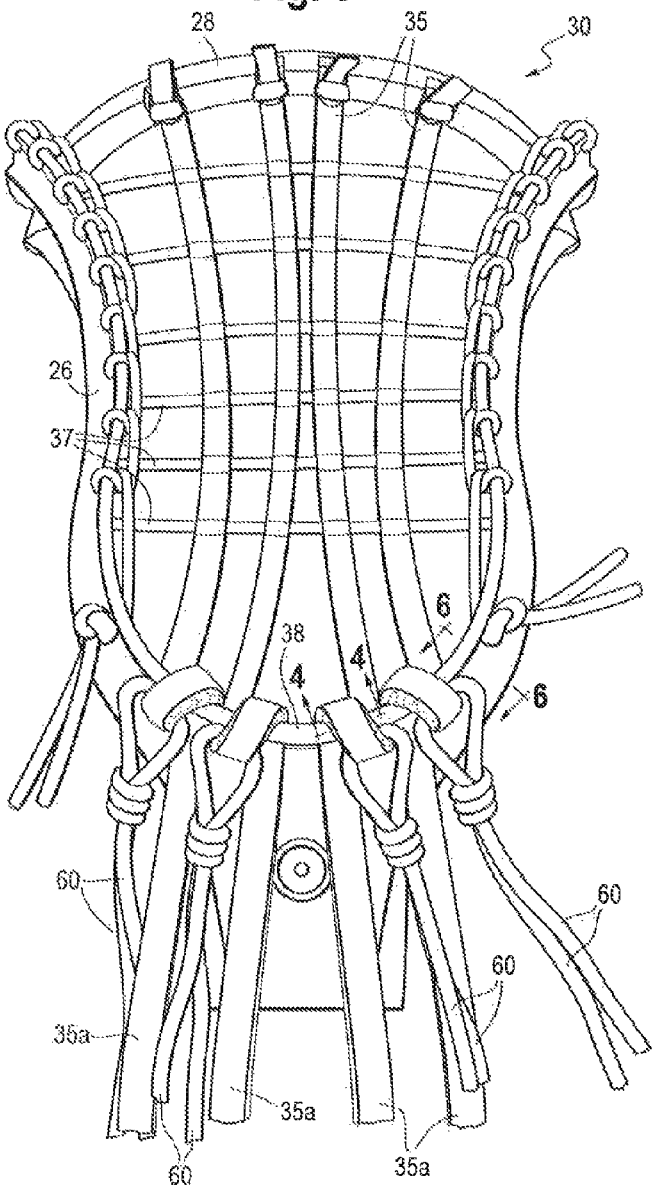
FIG. 3 is an enlarged rear perspective view of a lacrosse stick head of the present invention, with some of the cross-netting removed for ease of viewing.
Figure 4:
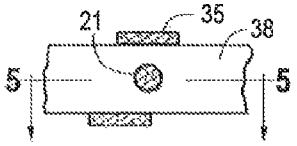
FIG. 4 is a view along reference line 4-4 of FIG. 3.
Figure 5:
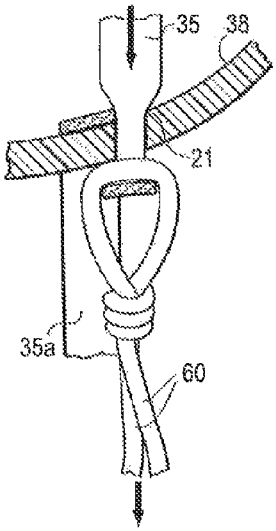
FIG. 5 is a view along reference line 5-5 of FIG. 4.

The components in the drawings are not necessarily to scale; emphasis is instead placed upon clearly illustrating the principles of the present invention.

DETAILED DESCRIPTION OF THE PREFERRED EMBODIMENTS

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Referring to FIG. 3, a lacrosse stick head 30 according to the present invention is shown and now described. Lacrosse stick head 30 may again include longitudinally-extending thongs 35 and transverse cross-laces 37, together forming a ball-receiving, trough-shaped pocket. However, head 30 enables on-the-fly adjustment of in the tension of thongs 35, as now described.

Still referring to FIG. 3, thongs 35 are preferably sized so that the apertures 21 in bottom wall 38 and lip 28 through which the thongs pass serve as pinch points for the thong. For example, thongs 35 may be ¼-inch wide, and have a ⅛-inch thickness, while the wall apertures may be circular with a ⅛-inch inner diameter. Alternatively, it may be preferred to provide wall apertures with an inner rectangular cross-section, such as having ⅛-inch and 1/16-inch sides, or with other aperture geometries (star-shaped, etc.)

Still referring to FIG. 3, an adjustment mechanism, such as a tightening strip 60, for each thong 35 is provided. (Alternatively, a single tightening strip may be used to service two or more thongs, although this is not as preferred.) It can be seen that each end of thong 35 passes through a corresponding aperture in bottom wall 38, and is looped around bottom wall 38, creating two frictional pinch points: first, the aperture itself, and second, the bottom wall that the thong portion if looped around.

The pinch point friction exerted on the thong depends on the materials employed, and their dimensions. Different materials and different shapes and sizes will have different pinch point frictions.

While an adjustment mechanism consisting of a knotted loop is shown, adjustment mechanisms in alternative forms may be used, such as wire loops or flexible bands.

Figure 6:
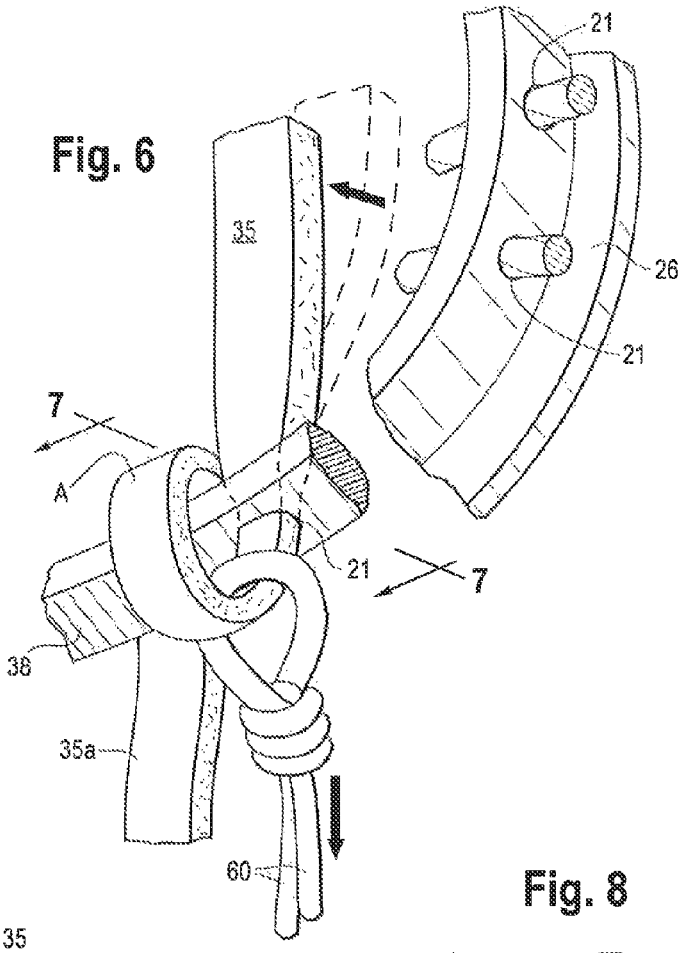
FIG. 6 is a view along reference line 6-6 of FIG. 3.
Figure 7:
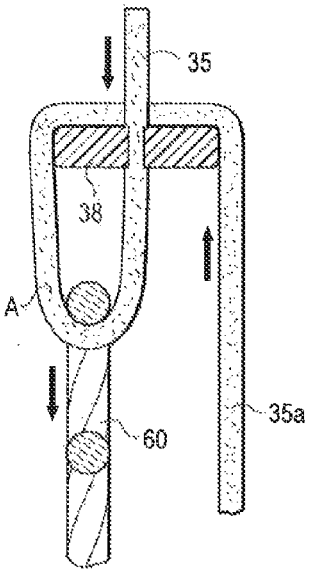
FIG. 7 is a view along reference line 7-7 of FIG. 6, showing the adjustment mechanism pulling on the leather thong in a direction away from the lip.
Figure 8:
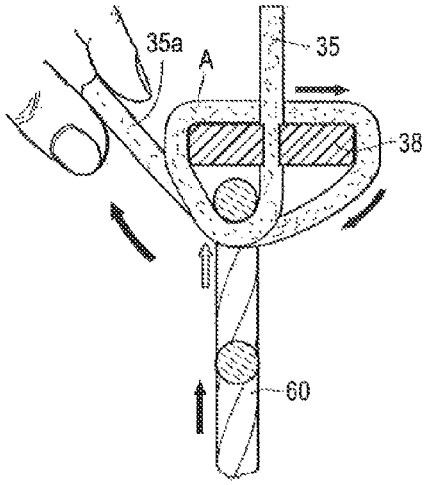
FIG. 8 is a progressive view similar to and following the step in FIG. 7 in which it has been tightened (in the area within the pocket), in which the leather thong has been cinched/tightened.

Referring now to FIGS. 6-8, pulling on tightening strip 60 in a direction away from lip 28, will create tension in the portion of thong 35 forming loop A (FIG. 7), causing loop A, located below bottom wall 38, to enlarge. Now, by pulling on the free end 35*a* of thong 35, this slack can be taken up and thong 35 can be cinched tight around wall 38 in its new, greater-tensioned position within head 16 (FIG. 8). (Note that adjustment mechanism/tightening strip 60 preferably includes a knotted loop 60A large enough to insert a finger or fingers, so that it may easily be pulled with sufficient force to enlarge the loop on the thong.)

Figure 9:
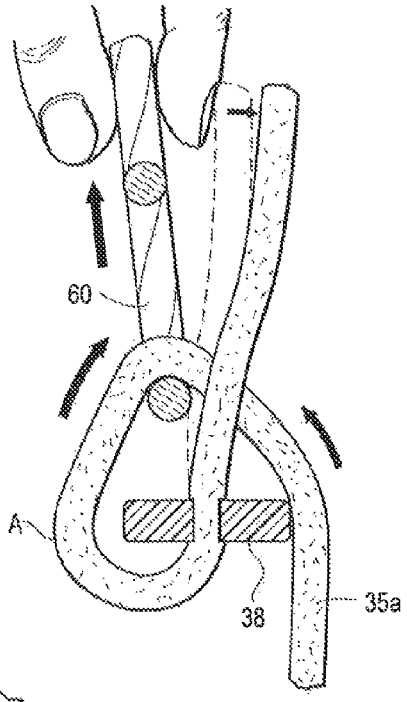
FIG. 9 is a view similar to FIG. 7, showing the adjustment mechanism pulling on the leather thong in a direction toward the lip.
Figure 10:
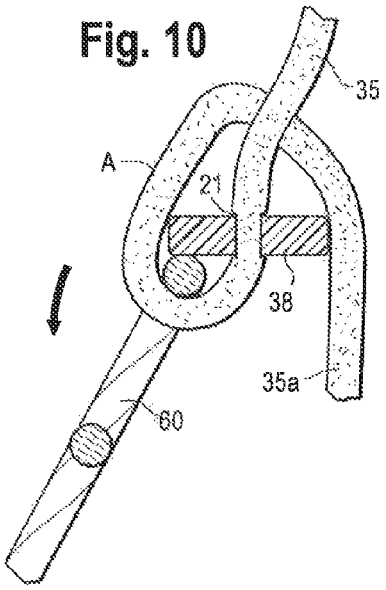
FIGS. 10 and 11 are progressive views similar to FIG. 7 in which the leather thong, following the step in FIG. 9 in which it has been loosened (in the area within the pocket), is being cinched/tightened.
Figure 11:
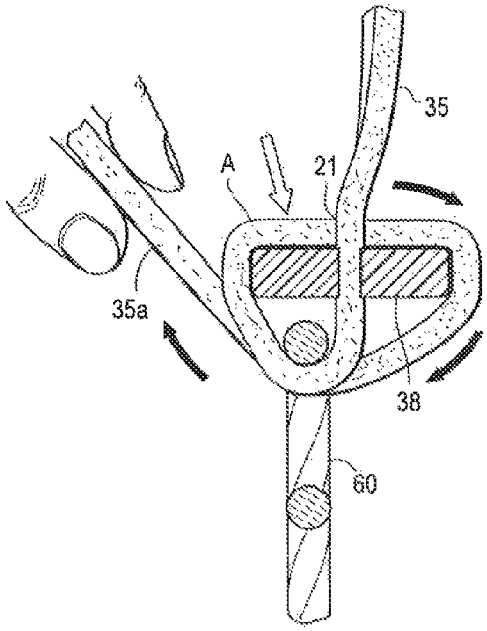

Conversely, referring to FIGS. 9-11, pulling on tightening strip 60 in a direction toward lip 28, will create slack in the portion of thong 35 forming loop A (FIG. 9). Loop A, this time located above bottom wall 38 (within head 16), will again enlarge, creating slack in thong 35. Now, pulling on free end 35*a* of thong 35 within head 16 will allow the slack from the loop to be taken up by thong 35, loosening tension in the thong (loop A will decrease in size as the thong is lengthened). Finally, pulling on free end 35*a* of the thong will cinch it tight around wall 38, leaving thong 35 in its new, slackened position within head 16 (FIG. 11).

The above description is not intended to limit the meaning of the words used in the following claims that define the invention. For example, while preferred embodiments have been described above, persons of ordinary skill in the art will understand that a variety of other designs still falling within the scope of the following claims may be envisioned and used. It is contemplated that future modifications in structure, function or result will exist that are not substantial changes and that all such insubstantial changes in what is claimed are intended to be covered by the claims.

I claim:

1. A method for manufacturing a lacrosse stick, the lacrosse stick extending along a longitudinal axis with a head extending in a direction normal to the longitudinal axis, and the head having a pocket whose height is adjustable, comprising:

providing a frame extending in a longitudinal direction and having four frame sections; including opposing sidewall sections, and opposing lip and throat frame sections, each of the four frame sections including a plurality of apertures;

providing a pocket formed within the four frame sections, comprising lattitudinally-extending cross-stitching attached to the sidewall apertures, and longitudinally-extending thongs whose opposing ends are attached to apertures on the lip and throat sections;

wherein the pocket height has the ability to be adjusted as the ends of the two or more thongs are adjustably connected to corresponding throat frame section apertures, and the end of each of the two or more thongs is secured by at least two pinch points, including a portion of the throat frame section and a throat frame section aperture, and the pinch points for each of the two or more thongs are used to form a thong loop which is connected to an adjustment mechanism, whereby tensioning the adjustment mechanism, enlarges the thong loop and enables tension in the corresponding thong to be tightened or loosened.

2. The method of claim 1, wherein the thongs comprise rawhide or leather.

3. The method of claim 1, wherein the adjustment mechanism comprises a slip loop.

4. The method of claim 1, wherein the adjustment mechanism comprises a wire loop.

5. The method of claim 1, wherein the adjustment mechanism comprises a flexible band.

* * * * *